US008151860B2

(12) United States Patent
Mortensen et al.

(10) Patent No.: US 8,151,860 B2
(45) Date of Patent: Apr. 10, 2012

(54) POROUS METAL ARTICLE AND METHOD OF PRODUCING A POROUS METALLIC ARTICLE

(75) Inventors: Andreas Mortensen, St-Saphorin sur Morges (CH); Russell Goodall, Caldicot (GB)

(73) Assignee: Ecole Polytechnique Federale de Lausanne (EPFL), Lausanne (CH)

( * ) Notice: Subject to any disclaimer, the term of this patent is extended or adjusted under 35 U.S.C. 154(b) by 327 days.

(21) Appl. No.: 12/527,022

(22) PCT Filed: Feb. 15, 2008

(86) PCT No.: PCT/EP2008/051883

§ 371 (c)(1),
(2), (4) Date: Aug. 13, 2009

(87) PCT Pub. No.: WO2008/099014

PCT Pub. Date: Aug. 21, 2008

(65) Prior Publication Data

US 2010/0021758 A1 Jan. 28, 2010

(30) Foreign Application Priority Data

Feb. 16, 2007 (WO) ..... PCT/IB2007/050519
Nov. 2, 2007 (WO) ..... PCT/IB2007/054453

(51) Int. Cl.

| | |
|---|---|
| ***B22C 9/00*** | (2006.01) |
| ***B22C 1/00*** | (2006.01) |
| ***B22C 1/16*** | (2006.01) |
| ***B22D 19/00*** | (2006.01) |

(52) U.S. Cl. ..... 164/15; 164/520; 164/525; 164/98

(58) Field of Classification Search ..... 164/15, 164/520, 525, 91, 98
See application file for complete search history.

(56) References Cited

U.S. PATENT DOCUMENTS

| | | | | |
|---|---|---|---|---|
| 3,052,967 | A * | 9/1962 | Fischer | 419/2 |
| 3,210,166 | A | 10/1965 | Carlson | |
| 3,236,706 | A * | 2/1966 | Kuchek | 216/56 |
| 6,660,224 | B2 * | 12/2003 | Lefebvre et al. | 419/2 |
| 7,290,586 | B2 * | 11/2007 | Sambrook | 164/98 |

FOREIGN PATENT DOCUMENTS

EP 1808241 7/2007

OTHER PUBLICATIONS

Conde, Yves et al., Replication Processing of Highly Porous Materials, Advance Engineering Materials 8(9), 795-803 Coden: Aenmfy; Issn: 1438-1656, 2006, XP009100381.

(Continued)

*Primary Examiner* — Kevin P Kerns
(74) *Attorney, Agent, or Firm* — Gottlieb, Rackman & Reisman, P.C.

(57) ABSTRACT

A metal article containing at least 10% interconnected porosity is produced by using a preform.

To make the preform, an organic binder, a wetting agent and a granular material are mixed to obtain a mouldable paste that combines 10 vol. pct. or more of the granular material, this material dissolving easily in a liquid solvent. The paste is shaped into an aerated preform, thus creating an open pore space to be infiltrated by the metal or alloy.

The wetting agent is evaporated and the preform is baked to a temperature sufficient to degrade the binder and create a network of interconnected open porosity in the preform. Then, the open pore space is filled with the liquid metal or alloy.

All or part of the baked preform can be easily leached by a liquid solvent through the network of fine pores.

15 Claims, 2 Drawing Sheets

OTHER PUBLICATIONS

Despois et al., Uniaxial Deformation of Microcellular Metals, Acta Materialia, Elsevier, Oxford, GB, vol. 54, No. 16, Sep. 1, 2006, pp. 4129-4142—XP005612596 issn. 1359-6454.

Gaillard, C. et al., Processing of NaC1 Powders . . . Materials Science & Engin., A374(1-2), 250-262 Coden: MSAP3; ISSN 0921-5083, 2004, XP005391656 Experimental -www.elsevier.com.

* cited by examiner

POROUS METAL ARTICLE AND METHOD OF PRODUCING A POROUS METALLIC ARTICLE

FIELD OF THE INVENTION

The present invention relates to the production of highly porous metal bodies, including materials designated as metal foams, microcellular metals, metal sponge, or metal lattice truss structures, all of these being metallic structures with, as a guideline, at least 10% (and typically much more) porosity. A rather wide range of processing routes have been developed to make such porous metal materials (as described in, for example, Metal Foams: A Design Guide, M F Ashby, A G Evans, N A Fleck, L J Gibson, J W Hutchinson, H N G Wadley, 2000, Butterworth-Heinemann, [J Banhart, Progress in Materials Science 46 (2001) 559-632], http://www.metal-foam.net/).

BACKGROUND OF THE INVENTION

More specifically, the invention relates to the production of such material or structures by a casting process that involves infiltrating molten metal around a removable refractory mould or space holder that defines the foam structure. There are already several processing routes for metal foams that fall into this class, reviewed for example in [M F Ashby, A G Evans, N A Fleck, L J Gibson, J W Hutchinson, H N G Wadley "Metal Foams: A Design Guide" Butterworth-Heinemann, Boston, (2000)], [J Banhart, Progress in Materials Science 46 (2001) 559-632], [Y Conde, J-F Despois, R Goodall, A Marmottant, L Salvo, C San Marchi & A Mortensen, Advanced Engineering Materials 8(9) 795-803 (2006)]. Due to the complex interconnected porosity, normally exceeding 40% of the total volume of the article, the requirements of such a mould or space holder and hence methods by which they are made are generally different from those used to shape hollow castings.

A method using investment casting with a polymer precursor is disclosed in [Y Yamada, K Shimojima, Y Sakaguchi, M Mabuchi, N Nakamura, T Asahina, T Mukai, H Kanahashi & K Higashi, Journal of Materials Science Letters, 18 (1999) 1477-1480]; it is also guessed that this is the method used to produce "Duocel metal foams" currently marketed by the ERG Materials and Aerospace Corporation (http://www.ergaerospace.com/), [M F Ashby, A G Evans, N A Fleck, L J Gibson, J W Hutchinson, H N G Wadley "Metal Foams: A Design Guide" Butterworth-Heinemann, Boston, (2000)]. In this method, an open-celled organic foam of, e.g., polyurethane is filled with a refractory slurry, typically an investment casting moulding compound, which is cured after which a heat treatment is used to densify the mould and remove the initial polymer precursor. Metal is cast into the mould so formed, and the mould material will then be removed using conventional methods, e.g. by mechanical shaking or with a water jet.

U.S. Pat. No. 3,052,967 cited by [J Banhart, Progress in Materials Science 46 (2001) 559-632] discloses a method of manufacturing a foam using a preform of sand particles held together with a binder that decomposes at high temperatures, allowing the sand to be shaken out.

If casting is sufficiently rapid, then sintered polymer granulates can be used as the preform with aluminium. After casting, a thermal pyrolysis treatment is used to remove the polymer. This method is, for example, described by the Fraunhofer Institute in Bremen, http://www.ifam.fraunhofer.de/index.php?seite=/2801/leich tbauwerkstoffe/offenporoese-strukturen/&lang=en.

Alternatively, sintering of metal powder around removable space holders may be used. Powder of the desired metal is mixed with a sufficient quantity of particles of a material that can be removed either by water or a suitable heat treatment, before sintering of the powder to produce a cohesive material. During this stage the space holder particles retain the porosity in the foam. Examples of space holders used include salt [Y Y Zhao, D X Sun, Scripta Mater. 44 (2001)] and urea [B Jiang, N Q Zhao C S Shi, J J Li, Scripta Mater. 53 (2005) 781-785] (both removed by dissolution in water).

A relatively simple method uses grains of normal table salt to define the foam porosity, as described in U.S. Pat. No. 3,236,706. If the grains percolate, then after infiltration of the intergranular spaces with molten metal and solidification of the latter the salt may be removed by dissolution in water. Research has developed this process to vary the foam porosity (in the range 0.6-0.9), pore shape (by using different shapes within the set of possible salt crystal forms), and pore size (in the range 5 μm-2 mm), see [C San Marchi & A Mortensen, Acta Materialia 49 3959 (2001); C San Marchi, J-F Despois & A Mortensen, Acta Materialia 52 2895 (2004); J-F Despois, Y Conde, C San Marchi & A Mortensen, Advanced Engineering Materials 6(6) 444 (2004); C Gaillard, J-F Despois, & A Mortensen, Materials Science and Engineering A 374(1-2) 250 (2004); R Goodall, A Marmottant, L Salvo & A Mortensen, Materials Science and Engineering A 465 (1-2) 124 (2007)]. However, the method is limited by the size and shape of available salt crystals, the fact that salt grains larger than about 0.5 mm diameter cannot be compacted in the same way as the smaller grains, and the slow rate of preform removal by dissolution.

SUMMARY OF THE PRESENT INVENTION

The purpose of the invention is to produce an article with at least 10%, preferably 40% or more, interconnected porosity using a shape holder that combines (i) ease of shaping; (ii) sufficient strength at metal melting temperatures combined with chemical inertness in contact with metal, and (iii) rapid and easy removability, economically and without at any stage producing ecologically harmful waste or emissions.

Embodiments of the present invention provide a process for producing a metal or alloy article containing at least 10% interconnected porosity, using a preform, this process comprising:

- mixing an organic binder, a wetting agent and a granular material, to obtain a mouldable paste that combines 10 vol. pct. or more of said granular material, said granular material dissolving easily in a liquid solvent, and said organic binder being thermo-degradable;
- shaping the mouldable paste into an aerated preform and providing an open pore space to be infiltrated by the metal or alloy;
- evaporating said wetting agent and baking said preform to a temperature sufficient to degrade the organic binder and create a network of interconnected open porosity in the preform;
- filling said open pore space with a liquid metal or a metal alloy.

The process advantageously uses a mouldable paste or dough containing a fine, preferably water-wetted and water-soluble, refractory material, and an organic binder preferably forming a carbonizable material to aid binding. This paste or dough may be formed using many possible methods, including for example dough shaping techniques of the food industry or computer-controlled three-dimensional free-forming methods, into the desired shape and size of the porosity in the porous metal article. It is then baked to harden while retaining this shape. This makes it suitable for use as a soluble space holder to be placed in a mould for casting metal. For example, the dough can be shaped into many small spheres of a controlled size, which are then combined by simple packing into a preform with the correct volume fraction porosity and pore size.

The space holder or preform is then heated in air to cause hardening of the moulding material, with a further heat treatment to remove volatile substances that would otherwise be introduced into the casting and to reduce the total amount of binder phase present. It is then placed in a mould and metal is cast, under pressure if opportune, this pressure remaining sufficiently small that pores within the baked paste or dough making the preform are not filled with metal. After solidification and machining (if required), the preform is removed by contact with a liquid solvent, preferably water, to leave a metal article containing 40% or more by volume interconnected porosity. The nature of the space holder produced by the present invention causes a significant enhancement in the speed of this last operation by a combination of the fine constituent granule size, water wettability and interconnected porosity of the space holder material herein disclosed. Another liquid than water (for instance, alcohol or other solvents) could be used. The solvent and the granular material may be chosen in such a manner that the granular material is well wetted by the solvent.

According to one particular feature, the size of open pores within the preform material is finer by a factor equal to or greater than three compared with said open pore space.

According to one particular feature, the aerated preform is placed in a mould and subsequently said open pore space is filled, preferably by a low-pressure method, with liquid metal or a metal alloy, for example aluminium or one of its alloys, and after solidification of the metal or the alloy, all of the preform material is washed out of the solidified metal or the solidified alloy by washing with a liquid solvent such as water. With such a method, a metallic foam having pore sizes higher than 1 mm may be obtained with a high degree of control. Above this size with conventional methods, salt particles tend to crack rather than deform during the preform compaction stage, making it difficult to control pore shape or pore volume fraction. The organic binder and the wetting agent overcome this limitation of conventional methods.

According to another feature, the mouldable paste essentially consists of soluble particles of NaCl and a carbon-containing binder. Carbohydrates, preferably a mixture of ground grain flour are exemplary compounds for the binder. The paste including such particles of NaCl or similar granular material that can withstand contact with the molten metal during casting may be shaped, which is another important advantage of the present invention. Salt particles may be ground to below 150 μm diameter but, using this method, larger paste particles may be used to produce larger preforms (having dimensions of several centimetres or more).

In the process disclosed here, metal articles of high porosity may be obtained after dissolution of the preform material. Dissolution times are very short in the present process compared with conventional processes, where the leaching process is rate-limited by diffusion over distances on the order of several pore diameters. The reason why dissolution can be obtained so quickly (instead of several days with conventional methods for pieces of a few centimeters wide) is the inner porosity of the preform baked body. This inner porosity is created by evaporation of the wetting agent and/or by pyrolysis of the binder. Evaporation and pyrolysis may be performed through a thermal treatment, typically to temperatures of 400-500° C. for preforms designed to produce highly porous aluminium. The organic binder, for instance a flour component, becomes pyrolyzed and much of the remaining carbon is removed by reaction with oxygen. This leaves behind a moulded salt preform, which contains many fine pores.

According to another feature, the mixture to obtain said mouldable paste contains 5-20 wt % organic binder, 50-80 wt % granular material and 15-25 wt % water as wetting agent. Such a composition is adapted to facilitate the shaping of the preform material and increase the rate of preform removal by dissolution.

According to another feature, the evaporating comprises heating the paste for 1-5 hours at least one temperature between 100° C. and 500° C. to cause hardening. The preform may be heated at 100-200° C. at first, after which the hardened preform is heated at 400-500° C. for up to a further 16 hours to reduce the carbon residue remaining from the binder.

According to another feature, the shaping comprises shaping the mouldable paste into discrete balls that are pressed together to produce said aerated preform. Alternatively, the mouldable paste may be shaped into discrete cylinders or other suitable forms that are pressed together to produce said aerated preform.

According to another feature highly porous metal produced by the present invention is combined with at least one phase-change thermal management material, for example paraffin. The resulting composite material combines good thermal conductivity (due to the porous metal) with a high thermal storage capacity (due to the phase change material) and may be useful in thermal management applications.

More generally, the porous metal article can be used for many applications such as filtration, heat exchange, acoustic applications (in sound absorption for example), catalysis (as catalyzer support materials), or a combination thereof. Ducts or similar components may be also housed in the porous metal article.

According to another feature, a porous metal article produced according to the process is seamlessly combined with a dense metal article by simply casting the metal into a mould that leaves open space next to the preform prepared according to the present method. The resulting casting then features two regions, one dense and one highly porous, seamlessly connected; this ensures greater strength and greater conductivity at the interface between the porous and the dense materials. Such features can be of great advantage in, for example, heat-transfer applications of materials produced by the present invention.

Embodiments of the present invention further provide a preform suitable for producing a metal or alloy article containing at least 10% interconnected porosity, characterized in that it comprises:

- a baked body containing hollow spaces and essentially comprising particles of a granular material and a carbon-containing binder, said baked body being soluble in water,
- a first open porosity defined by the hollow spaces of said body and designed to be infiltrated with a liquid metal or metal alloy; and
- a second open porosity corresponding to a network of fine spaces between adjacent body particles making the preform and designed to be filled with water.

Through the use of a suitable carbon-containing binder, the preform may be easily shaped so as to obtain a metal or alloy article containing a high level of interconnected porosity. Furthermore, the fine open porosity present inside the baked body makes the leaching operation much faster.

According to another feature, the largest interparticle spaces in the body are of the order of 100 μm. Accordingly, the fine open porosity is not infiltrated at all by molten metal or alloy.

The invention also provides a highly porous metal article containing hollow spaces of regular defined shape produced by casting molten metal in a mould, produced using said process, characterized in that the pores have a diameter of 3-7 mm and porosity represents 60-95% of the volume of the article. A porous article having such pores cannot easily be obtained with conventional methods because large salt particles are often irregular in shape and crack when pressed together instead of deforming, and so give pores with only small windows between them. Moreover, articles of large sizes may be obtained with such open porosity. For instance an article with length L>5 cm and another characteristic dimension D>4 cm can be produced (D may be the diameter or the longer side of a section). Porous metallic articles of such dimensions and containing hollow spaces of regular defined shape cannot be industrially produced with conventional methods because of the difficulty in controlling pore shape and also the long time that is then required for the dissolution step.

Other features and advantages of the invention will become apparent to those skilled in the art during the description that will follow, given by way of non-limiting example, with reference to the appended drawings.

DETAILED DESCRIPTION OF THE INVENTION

In the various figures, the same references are used to designate identical or similar elements.

Figure 1:
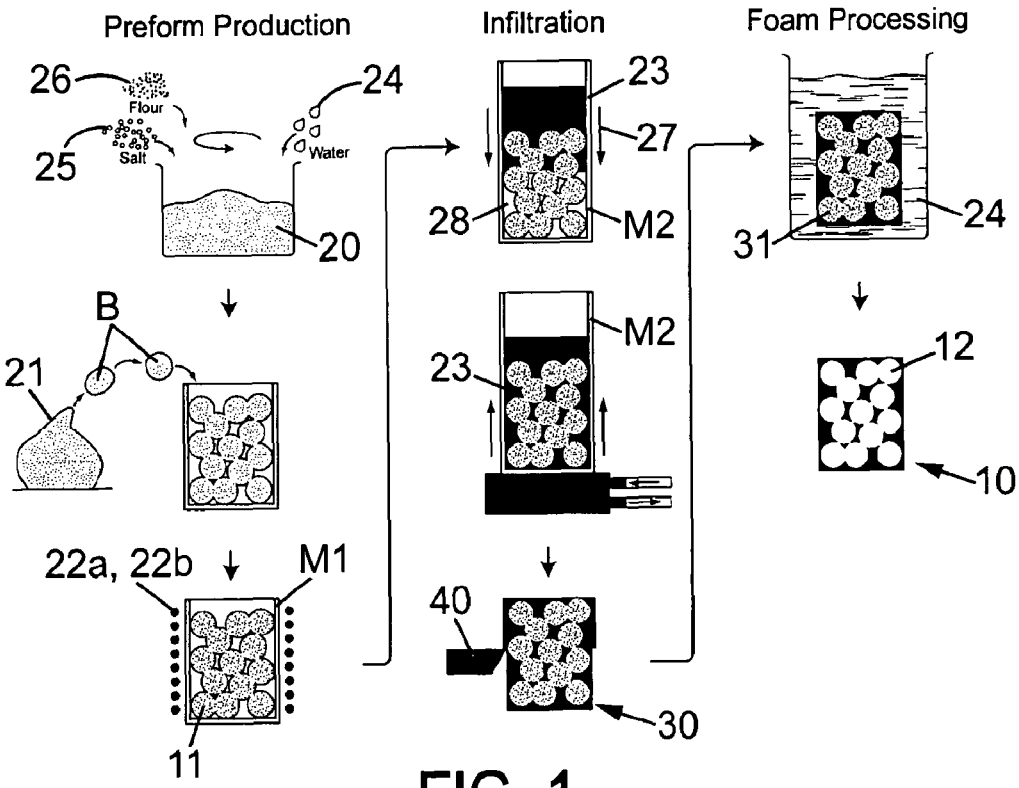
FIG. 1 is a schematic diagram of an exemplary process according to the invention.

The present invention deals with a method of casting a porous metal article 10. Referring to FIG. 1, the process is performed by using a preform 11 that defines the shape and spatial distribution of internal porosity 12. In order that the size and shape of the pores in the material be well controlled, this process specifies that the preform 11 be made from a paste 20 or dough that, after suitable forming 21 and heat treatment (22*a*, 22*b*), leaves behind a refractory pattern with sufficient mechanical strength and chemical inertness at high temperature to resist contact with molten metal 23 during casting, and an interconnected internal pore network that, combined with good wettability and solubility in water, causes it to be dissolved rapidly. The speed of this last step is increased significantly over other soluble space holders by the fact that the preform 11 too contains a much finer network of interconnected porosity and is wetted by the solvent 24, which is therefore rapidly drawn by capillary forces into the preform 11. This causes the soluble phase to dissolve rapidly into the solvent 24, such that the preform 11 collapses shortly thereafter.

The paste 20 will be made from particles 25 of a refractory material soluble in a suitable solvent 24, a small amount of this solvent 24 and an organic additive 26 to aid paste formation. The amount of the solvent 24 may be less than 20% vol, and even less than 5%. The organic additive 26 may contain the solvent 24. The refractory particles 25 may be, but are not limited to, NaCl, $NaAlO_2$, $Al_2(SO_4)_3$, BaS, $K_2SO_4$ or $Na_2S$. The salt is preferably the major component of the paste 20. The solvent 24 is, in the preferred embodiment, water but many other fluids could be used. Still in the preferred embodiment, the organic additive 26 may be ground wheat grain flour, syrup or other materials including flour derived from other plants. The organic additive 26 is thermo-degradable and forms a binder facilitating the forming 21. Balls B having a diameter higher than 5 mm may be assembled to build the preform. The paste 20 can in particular be used to make spheres or balls B which may be assembled into a preform for a relatively "classical" metal foam, or other shapes such as cylinders, which can be built into aligned preforms to produce porous materials having elongated pores with preferential directions for fluid or heat transport—many other pore shapes are of course possible. Being pasty or doughy, the preform 11 can furthermore be compressed so as to decrease fraction metal or alloy and/or to open the windows that connect individual pores in the final article 10. This flexibility with regard to pore size and shape is an important advantage of this process.

In the exemplary embodiment of FIG. 1, the manufacture of aluminium foams is performed by using a mixture of NaCl, water and grain flour as the principal constituents of the preform 11. The solvent 24 used as a wetting agent is evaporated during heat treatment (22*a*, 22*b*). Preferably, the wetting agent has a boiling point in the range 50-100° C.

In order to make a mouldable paste or dough 20, particles 25 of ground NaCl or other suitable granular material are mixed with the organic additive 26 such as ground grain flour and the solvent 24, typically water; ordinary grocery-grade wheat flour is suitable. As shown in FIG. 1, this paste 20 is then formed by any operation suitable for dough shaping, e.g., rolling, extruding, cutting or other shaping operations, into the form desired for the porosity 12 in the final piece. A heat treatment 22*a* turns the paste 20 into a solid which can be handled, and further heat treatment 22*b* reduces the amount of binder remaining and hardens it, leaving a porous soluble preform 11 with sufficient strength to resist the forces exerted during casting and sufficiently inert in contact with molten metal to retain its integrity during the casting operation, and containing a second network of inner porosity that is left behind by the water and the binder (e.g., flour). The further thermal treatment 22*b* is made at higher temperatures (in a non limitative embodiment: 400-500° C.) after the shaped parts have lost their water or similar solvent 24. The organic additive 26, for instance flour component, then becomes pyrolyzed and much of the remaining carbon is removed by reaction with oxygen. This leaves behind a moulded salt preform 11, which contains many fine pores.

Infiltration 27 of molten aluminium or alloy into the preform 11 may be done by gravity casting if the spaces 28 to be infiltrated are sufficiently large, if not with the assistance of an applied pressure in any of several pressure casting processes, said applied pressure remaining sufficiently low that the finer pores in the preform are not infiltrated with metal (gas pressure infiltration, die-casting, . . . ). Accordingly, the volume of infiltrated metal (23) is not higher than the total volume defined by the spaces 28 between the balls B. Infiltration 27 may be performed to obtain equality between these two volumes. Such a total volume may be estimated previously, to adapt then the pressure to be applied during infiltration 27.

After the metal or alloy is solidified the preform 11 may be rapidly removed by immersion of the piece 30 in water: water then penetrates within the finer pores of the preform 11, dissolving its soluble component, which in turn causes rapid collapse of the preform 11 leaving a metal article 10 with porosity 12 defined by the shape of the original preform 11. Before leaching 31, an optional machining may be performed, as shown in FIG. 1. Indeed, once the metal or alloy has solidified within the larger open pores of the preform 11, a machining step 40 can be carried out if needed (although near net-shape processing is possible), followed by dissolution in water.

Figure 2:
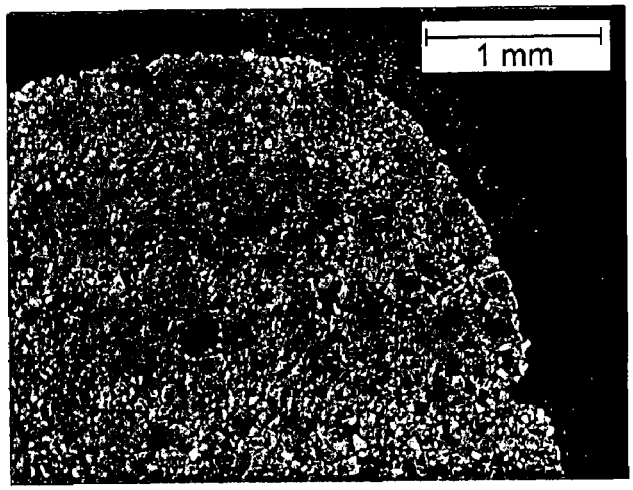
FIG. 2 is a scanning electron microscope image of a cross section through a sphere produced by the process, after heat treatment.

It should be understood that the preform 11 may be infiltrated with molten metal 23 such as aluminium or by any other material/alloy having a melting point lower than that of the refractory particles 25 (for NaCl, 801° C.). A control of the infiltration pressure is performed so that the open spaces 28 between the salt parts made from the paste 20 are infiltrated, but not the fine holes remaining within the preform material itself. Simple analysis of SEM images (Scanning Electron Microscope images) of cross sections through structures of salt made using this method, such as that shown in FIG. 2, indicates that refractory particles 25 occupy about 60% of the volume (as one would a priori expect) and the largest interparticle spaces are of the order of 100 μm. As aluminium does not wet salt, not infiltrating the preform material is actually relatively easy, as the larger spaces 28 will fill with metal at a significantly lower applied pressure than the fine pores in the heat-treated preform 11. The spaces 28 designed to be infiltrated with molten metal 23 are sufficiently large, typically at least higher than 0.3 mm and preferably higher than 0.6 mm if a porous material with pores of diameter 3 mm or above is to be produced.

Leaching 31 is performed rapidly because of infiltration of solvent 24 in the second network of inner porosity. This is a further advantage of the process. All or part of the baked preform can be easily leached through the network of fine pores shown in FIG. 2.

Figure 3:
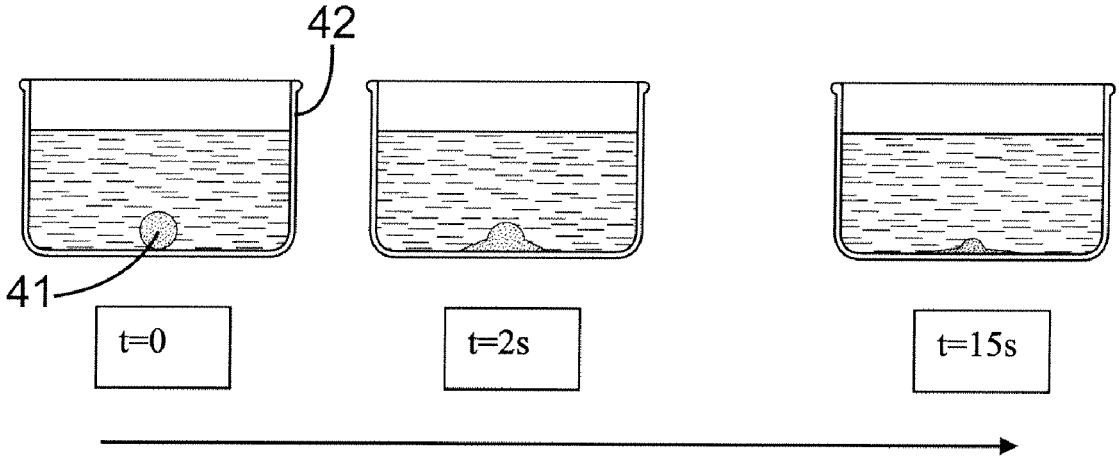
FIG. 3 shows a series of images illustrating quick collapse of a 5 mm diameter sphere of porosity as shown in FIG. 2, when introduced in a beaker of tap water at room temperature.

FIG. 3 shows a series of images of a 5 mm diameter sphere 41 of salt made according to the embodiment shown in FIG. 1. The sphere 41 is dropped in a beaker 42 of tap water at room temperature. As seen, the time between immersion and complete collapse of the sphere 41 is less than 15 seconds. A grain of solid salt of same size would not be dissolved as quickly: the time required for a 5 mm diameter grain of solid salt to dissolve is longer by more than an order of magnitude. As well as this difference in dissolution speed, an interesting observation is that salt structures made by this process will collapse even when immersed in a saturated salt solution, only slightly slower than with distilled water.

Part of the explanation for this difference is the fine porosity that is left in the preform 11 made by the dough route. In the exemplary embodiment, these pores remain when first the water, and then most of the flour, are driven off by the thermal treatment (22*a*, 22*b*). When the preform 11 is subsequently brought into contact with water, the water wets the salt and is drawn into these fine pores by capillarity, and is thus rapidly taken throughout the preform 11. Dissolution would be the same with any solvent having similar properties in relation with the refractory particles 25 of the paste 20. Another part of the explanation could be related to the collapse of the preform 11 even in saturated salt solution; this shows that it is not purely dissolution of the contact points between salt grains that leads to the preform collapse (although this probably does play a role). Rather, the water has a very low dihedral angle with salt, and so "cuts" most salt grain boundaries leading to preform collapse. The increase in preform removal speed permitted by this collapse over the solid salt (which requires complete dissolution) is a significant advantage of the process.

Although a detailed assessment of the environmental impact of the process at an industrial scale has not been conducted, a priori it should also be attractive in this regard. All ingredients of the preform 11 may be natural: water, salt, and flour in the embodiment shown in FIG. 1. Since the partial pressure of salt at baking temperatures is very low (a value of $1.5\times10^{-22}$ Pa is a reasonable estimation), it should be easy to avoid release into the atmosphere. Final stages of baking, in which the flour is pyrolyzed, cause some emissions; however, these are non-toxic and likely to be easy to filter (essentially, these are what comes off when one burns toast). And since the leaching 31 can be carried out in water without any additions, it results in the release of nothing more than NaCl. This should not prove problematic for coastal sites, and for inland production closed systems could be designed where boiling of the water recovered the salt for reuse after a crushing step. The present invention is further illustrated below using specific examples of its use; these are of course illustrations and many variations of the basic invention can be devised.

EXAMPLE 1

15.2 g of ground wheat grain flour was mixed with 30 g (30 ml) of water to form a thin paste. To this paste 108.2 g of ground NaCl particles (all below 150 μm diameter) was gradually mixed in. This changed the mixture to a stiff paste 20 that could easily be moulded. The paste 20 was shaped (by hand) in a shaping step 21 into spheres or balls B of about 6 mm diameter, which were then rolled in a small amount of salt to dry them further and reduce shape change by creep of the paste before curing. The spheres were packed into a salt-coated mould M1 30 mm diameter and 70 mm height, and left for 2 hours to dry. The mould M1 was then heated to 200° C. for 2 hours, after which the spheres were observed to have turned brown or black; the temperature was then increased to 500° C. After 16 hours at this temperature the spheres were observed to have turned grey/white, and the preform 11 as a whole could be removed from the mould M1. The preform 11 was placed in another mould M2 with an ingot of Al-12Si (eutectic composition) alloy on top. This was heated to 600° C. under vacuum, so that the molten metal 23 formed a liquid head about 15 cm above the preform 11, causing infiltration 27. After solidification the excess dense metal was removed, and the part with the preform 11 was placed under a running tap. After 20 seconds the article 10 was removed from the water and dried, and the preform 11 was found to have dissolved and been washed away completely.

EXAMPLE 2

15.1 g of ground wheat grain flour was mixed with 30.3 g of water. To this mixture, 103.8 g of salt was added to form a smooth paste 20. The paste 20 was shaped into spheres or balls B of about 7 mm diameter, which were then rolled in a small amount of salt to dry them further and reduce shape change by creep of the paste 20 before drying. The spheres were packed into a salt-coated mould M1 30 mm diameter and 70 mm height, with a Al 6060 alloy tube of 8 mm diameter placed vertically running through the centre of the preform. The preform was dried at 70° C. for 3 hours, and was then heated to 200° C. for 16 hours, after which the spheres were observed to have turned black and the temperature was increased to 400° C. for a further 4 hours until the spheres were observed to have turned grey/white. The preform 11 was then removed from the mould M1. The space holding aluminium tube was removed and cleaned, and sealed at the ends before being replaced, and the preform 11 was placed in a crucible forming mould M2 and heated to 600° C. in air. Molten Al-12Si alloy 23 at 600° C. was poured into the mould M2, forming a liquid head about 20 cm above the preform 11. After solidification the excess dense metal was removed, and the part with the preform 11 cut into 5 mm thick slices. Several of these slices were placed under a running tap. After 10 seconds they were removed from the water and dried, and the preform 11 was found to have dissolved, leaving an open celled metal foam structure around a tube.

EXAMPLE 3

8.03 g of ground wheat grain flour was mixed with 20.47 g of water and to this mixture 88.76 g of ground NaCl was added to form a smooth paste 20. The paste 20 was formed into spheres or balls B of around 6 mm diameter, and these were placed in a mould M1. The preform was heated at 200° C. for 2 hours. The temperature was increased to 500° C. and the preform was left for a further 16 hours. The preform 11 was then placed in a crucible forming mould M2 underneath an ingot of 99.99% pure aluminium. This was heated under vacuum to 710° C. and, once the metal 23 was molten, 20 mbar argon was allowed into the furnace, causing infiltration of the preform 11 by the metal 23. After cooling excess dense metal was cut from the preform 11 leaving a cylinder of 36 mm diameter and 28 mm height. The sample piece 30 was then placed under a running tap. After 45 seconds it was examined and all the preform material was found to be removed. Measurement of the mass allowed the porosity to be calculated at 78%.

EXAMPLE 4

Two different pastes 20 were prepared. Paste n°1 was prepared with relatively little salt, by first mixing 18.8 g of ground wheat grain flour with 20.9 g of water. To this mixture 54 g of salt was mixed. This paste n°1 was very easy to shape, and was made into spheres of approximately 6 mm diameter. Paste n°2 was prepared with a relatively large amount of salt, by first mixing 6.2 g of ground wheat grain flour with 20.5 g of water. To this mixture, 99.1 g of salt was added. The paste produced did not undergo large deformations without breaking up. It was also made into spheres of around 6 mm diameter. Both types of sphere were placed in an oven at 200° C. for 2.5 hours, when the temperature was stepped up to 500° C. over a period of 3 hours. The samples were left at 500° C. for 15 hours.

After cooling, the strength and dissolution speed of the spheres was examined. Spheres made using paste n°1 (low salt) were fragile and could be crushed easily by hand. When dropped into a 200 ml beaker 42 of water they broke up into a dispersion of fine particles before they reached the bottom of the beaker 42 (taking a time of around 1 second). Spheres made using paste n°2 (high salt) were significantly stronger, and could not be crushed by hand. When placed into a 200 ml beaker 42 of water, the balls B broke up into fine particles over a period of 5 seconds.

EXAMPLE 5

8.03 g of ground wheat grain flour was mixed with 20.86 g of water. To this mixture, 88.94 g of salt was added to form a smooth paste 20. The paste was shaped into spheres of about 4 mm diameter, which were then placed in a mould M1 around an 8 mm diameter tube. The whole mould M1 was then placed in an oven at 200° C. for 3 hours, before the tube was removed and the temperature increased to 500° C. After a further 4 hours at this temperature, the preform 11 was removed from the mould M1. This example demonstrates that heat-treatment times need not be as long as in previous examples.

EXAMPLE 6

A paste was prepared using $NaAlO_2$ instead of NaCl. Sodium aluminate is a salt readily soluble in water and with a melting point of 1650° C., thus making it suitable for infiltration 27 with higher melting point metals 23, for example, copper. 4.06 g of ground wheat grain flour was mixed with 6.31 g of water. To this mixture 15.98 g of $NaAlO_2$ was added. The paste 20 formed was very easy to shape, and was made into spheres or balls B of approximately 7 mm diameter.

The spheres were placed in an oven at 200° C. for 1.5 hours, when the temperature was increased to 400° C. and maintained for a period of 16 hours. The temperature was then further increased to 600° C. for 8 h and then 800° C. for 16 h.

After cooling, the strength and dissolution speed of the spheres was examined. The spheres were found to be strong enough that crushing them by hand was not easy. When placed into a 200 ml beaker 42 of tap water, they broke up into fine particles over a period of 5-15 seconds.

EXAMPLE 7

A paste was prepared using sugar syrup instead of ground wheat grain flour. 2.71 g of sugar syrup was mixed with 1.55 g of water. To this mix 16.98 g of salt was added and mixed until a paste 20 was formed. The paste 20 was moulded into spheres of approximately 4 mm diameter, which were heated at 100° C. for 2 hours and then left overnight (approximately 16 h) at 500° C. When placed in 200 ml of room temperature tap water the resulting spheres were observed to break up over a period of 1-2 seconds.

As is apparent from this last example, it is not essential that the wetting agent (water in this case) be physically blended into the binder (syrup in this case) in the process if the two can be found naturally combined. A more diluted syrup could have been used in this example, as could an organic fluid of appropriate viscosity already containing a wetting agent that is later evaporated.

As shown by the above mentioned examples, highly porous metal articles 10, also called metallic foams, containing hollow spaces of defined shape can be obtained by the process. Such metallic foams are interesting for a variety of applications. Being open-celled, they are more likely to find uses in areas where there is a need for some heat transport between a solid (to which the foam is placed in intimate contact) and a fluid (which flows through the foam pores). From the point of view of maximising the thermal transport, it is interesting to note that this method can produce foams of exceptionally high purity, as (i) there is no chemical interaction or alloying between the preform (made of NaCl plus carbon-based residue from pyrolysis of flour) and aluminium and (ii) there is no need to add alloying elements or ceramic particles to the metal to assist with casting or foam stability. A chemical analysis of the composition of a laboratory sample of foam made using 99.99% Al feedstock in this process indicated that the content of the elements Ti, B, Fe, Si, Cu, Mn, Zn, Mg, Pb, Cr, Li, Ni, V, K, Sr, and Zr was each below the detection limit of 0.01 wt % (0.005 wt % in the case of Li). The only metallic elements present in the aluminium at a measurable level were Sn and Ca, of which there was just 0.01 wt % each.

Replacing salt with pyrolyzed salt dough in the replication process thus opens up new processing possibilities and indicates a new way of manufacturing open celled aluminium foams at low cost. The process features high flexibility in design of both the foam and the component architecture.

The present invention has been described in connection with the preferred embodiments. These embodiments, however, are merely for example and the invention is not restricted thereto. It will be understood by those skilled in the art that other variations and modifications can easily be made within the scope of the invention as defined by the appended claims, thus it is only intended that the present invention be limited by the following claims.

The invention claimed is:

1. A process for producing a metal or alloy article containing at least 10% interconnected porosity, using a preform, the process comprising:

mixing an organic binder, a wetting agent and a granular material, to obtain a mouldable paste that combines 10 vol. pct. or more of said granular material with respect to the total volume of the mouldable paste, said granular material being soluble in a liquid solvent, and said organic binder being thermo-degradable;

shaping the mouldable paste into an aerated preform and providing an open pore space to be infiltrated by the metal or alloy;

evaporating said wetting agent;

baking said preform to a temperature sufficient to degrade the organic binder and create a network of interconnected open porosity in the preform;

filling said open pore space with a liquid metal or a metal alloy.

2. The process of claim 1, wherein the size of open pores within the preform material is finer by a factor equal to or greater than three compared with said open pore space.

3. The process of claim 1, wherein said aerated preform is placed in a mould and subsequently said open pore space is filled by a low-pressure method with said liquid metal or said metal alloy and after a solidification of the metal or the alloy, all of the preform material is washed out of the solidified metal or the solidified alloy by washing with the liquid solvent.

4. The process of claim 1, wherein the mouldable paste consists essentially of soluble particles of NaCl and a carbon-containing binder.

5. The process of claim 1, wherein the binder consists essentially of carbohydrates.

6. The process of claim 5, wherein the binder consists essentially of a mixture of ground grain flour.

7. The process of claim 1, wherein said granular material consists essentially of salt particles that are ground to below 150 μm diameter.

8. The process of claim 1, wherein the mixture to obtain said mouldable paste contains 5-20 wt % organic binder, 50-80 wt % granular material and 15-25 wt % water as wetting agent.

9. The process of claim 1, wherein said evaporating comprises heating the paste for 1-5 hours at least one temperature between 100° C. and 500° C. to cause hardening.

10. The process of claim 9, wherein the preform is heated at 100-200° C. at first, after which the hardened preform is heated at 400-500° C. for up to a further 16 hours to reduce the carbon residue remaining from the binder.

11. The process of claim 1, wherein said shaping comprises shaping the mouldable paste into discrete balls that are pressed together to produce said aerated preform.

12. The process of claim 1, wherein said shaping comprises shaping the mouldable paste into discrete cylinders that are pressed together to produce said aerated preform.

13. The process of claim 1, wherein a porous metal article produced according to the process is combined with at least one phase change thermal management material to create a composite material.

14. The process of claim 1, wherein a porous metal article produced according to the process is seamlessly connected with a dense metal or alloy article that is cast simultaneously with the porous metal article.

15. The process of claim 1, wherein said open pore space is filled by a low-pressure method with aluminium or one of its alloys.

* * * * *